United States Patent [19]

Carella et al.

[11] 4,106,695

[45] Aug. 15, 1978

[54] TOY VEHICLE TRACK

[75] Inventors: Vincent Carella, Queens Village; Edwin A. Nielsen, Oceanside, both of N.Y.

[73] Assignee: Ideal Toy Corporation, Hollis, N.Y.

[21] Appl. No.: 751,636

[22] Filed: Dec. 17, 1976

[51] Int. Cl.[2] ..... A63H 19/30

[52] U.S. Cl. ..... 238/10 F; 46/1 K; 104/DIG. 1

[58] Field of Search ..... 238/10 R–F; 104/53, 60, 147 A, 149; 46/DIG. 1, 1 K, 216; 339/66 R, 66 M, 75 MP, 61 R, 61 C, 61 L, 61 M, 91 R, 151 M, 252 R, 252 P; 403/364, 367

[56] References Cited

U.S. PATENT DOCUMENTS

| | | | |
|---|---|---|---|
| 2,272,903 | 2/1942 | Bonanno | 238/10 C |
| 3,000,573 | 9/1961 | Schlau | 46/216 |
| 3,140,825 | 7/1964 | Edmondson | 104/60 |
| 3,206,122 | 9/1965 | Frisbie et al. | 238/10 F |
| 3,339,172 | 8/1967 | Heath | 339/61 L |
| 3,520,475 | 7/1970 | Ernst | 238/10 F |
| 3,753,203 | 8/1973 | Link | 339/61 R |
| 3,941,447 | 3/1976 | Hargrave et al. | 339/91 R |

FOREIGN PATENT DOCUMENTS

| | | | |
|---|---|---|---|
| 1,182,562 | 6/1959 | France | 238/10 E |

*Primary Examiner*—Drayton E. Hoffman
*Assistant Examiner*—Carl Rowold
*Attorney, Agent, or Firm*—Richard M. Rabkin

[57] ABSTRACT

A toy vehicle track section for use with similar track sections to form an interconnected track for a toy vehicle includes a base formed of electrically non-conductive material having opposite ends with at least one of the ends having a plurality of generally wedge shaped projections extending longitudinally therefrom. The other of the track ends has a plurality of generally complementary wedge shaped recesses for receiving the projections of an adjacent track section. The recesses and projections have cooperating means formed thereon for resisting longitudinal engagement of the projections from the recesses of an adjacent track section and the base includes longitudinally extending conductive strips associated with opposed projections and recesses to provide a complete electrical circuit about the track in its assembled form.

27 Claims, 7 Drawing Figures

FIG. 1
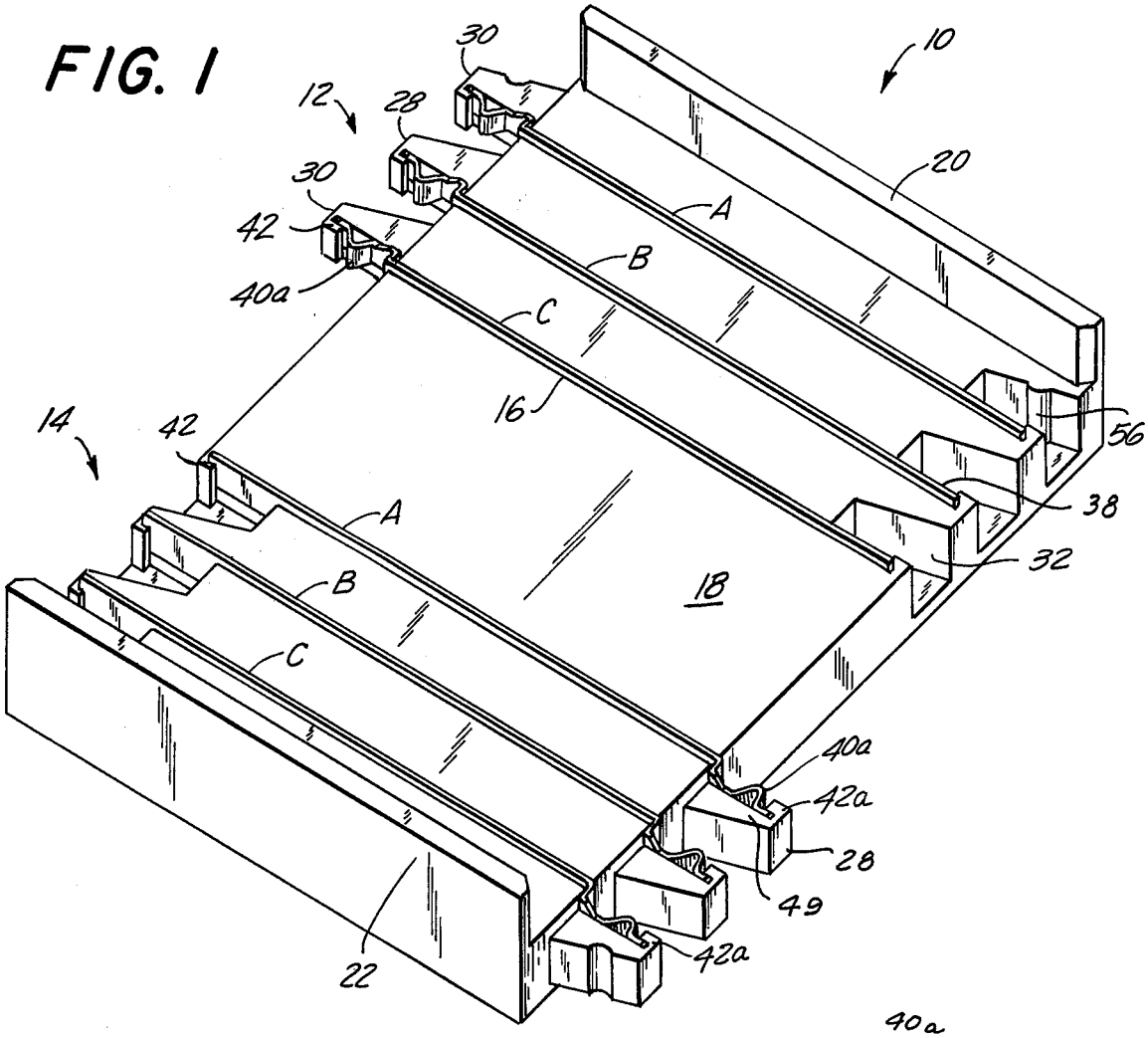
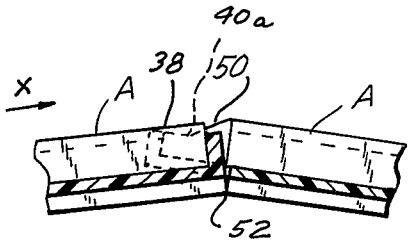
FIG. 5
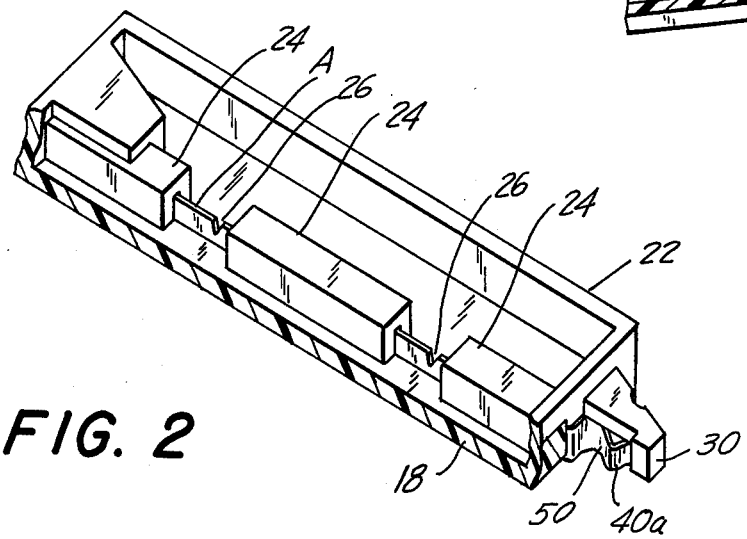
FIG. 2

TOY VEHICLE TRACK

The present invention relates broadly to toy vehicle games and in particular to track sections for use in such games.

Toy vehicle games have become increasingly popular in recent years, particularly those games in which miniature toy vehicles are remotely controlled on an endless track with the aid of electrical power supplied to the vehicle through conductors in the surface of the track. The tracks in such games can be simple ovals or consist of more complicated configurations including a variety of different types of twists and turns. Since it is not practical to supply the tracks for such games as unitary tracks, in preassembled form, the manufacturer typically provides a plurality of track sections of various shapes which are assembled and disassembled by the purchaser of the game as desired. This reduces the amount of space required for storage and shipping and also reduces storage problems for the purchaser.

The track sections for such previously proposed games are typically designed for end to end assembly to complete the continuous road bed surface and provide a continuous electrical contact for the brushes or current collectors mounted on the bottom of the toy vehicles. The need for continuous electrical contact between adjacent track sections is of utmost importance for these games to operate satisfactorily, since it is that continuous contact which maintains the continuous electrical circuit that enables the operators to control the speed of vehicles on the track and, in some cases, even the direction of the vehicle. However, with previously proposed track arrangements it is difficult to connect adjacent track elements, with the result that there is misalignment of the contact or conductor strips from one track section to another, so that the required continuous electrical contact is not achieved. In addition, some of these previously proposed track arrangements require the connection between track sections to be made by a lateral sliding arrangement, with or without an additional twisting motion, to complete the connection. As a result, not only is the connection extremely difficult for a small child to make, but also the interconnecting projections or tabs used to hold adjacent track sections in fixed relation to each other often will break during the assembly or disassembly operation. And, in such track sections the contact strip ends are usually simply bent over to be engaged in end abutting relationship between adjacent track sections. That relationship of the contact strip ends, in conjunction with the necessary lateral sliding movement of the track sections in order to complete the interlocking of the track sections often results in bending or breaking of the conductive strip ends at the end of the track, rendering the entire track section unsuitable for use.

Accordingly, it is an object of the present invention to provide a track section for toy vehicle games which is easily connected and disconnected from adjacent track sections.

Another object of the present invention is to provide a toy vehicle track section which is adapted to be connected to adjacent track sections with a simple longitudinal sliding movement.

Another object of the present invention is to provide a toy vehicle track section which assures positive contact between the contact strips of adjacent track sections.

Yet another object of the present invention is to provide a toy vehicle track section which is relatively simple in structure and manufacture.

Another object of the present invention is to provide a toy vehicle track section of the character described which is durable in use and economical to manufacture.

In accordance with an illustrative embodiment of the present invention a track section for toy vehicles is provided which is adapted to be connected by a simple longitudinal sliding movement with adjacent track sections in an aligned interconnection so that electrically conductive strips in each section align with and are in positive electrical contact with corresponding conductive strips of adjacent track sections. Each track section consists of a base formed of an electrically non-conductive material such as molded plastic of known chemical composition, having opposed ends which include a plurality of longitudinally extending projections and recesses formed therein. The projections and recesses are of generally complementary configuration and extend longitudinally of the track in order to be connected in mating relation by a simple sliding movement.

A plurality of conductive strips are mounted in the track section and respectively extend between a projection and a recess on opposite ends of each track section. The strips have opposed ends respectively located in their associated projection and recess for engaging the ends of corresponding strips in adjacent track sections connected thereto. At least one of the recesses and projections has a cooperating detent arrangement formed therein for resisting longitudinal movement of the projections from the recesses of an adjacent track section. In addition, at least one end of each of the contact strips is bent to form a spring contact which wipes the end of a contact strip in an adjacent track section when the track sections are assembled.

The above, and other objects, features and advantages of this invention will be apparent in the following detailed description of an illustrative embodiment thereof, which is to be read in connection with the accompanying drawings, wherein:

FIG. 1 is a perspective view of a track section constructed in accordance with the present invention. It is noted that for simplicity in illustration, the track section has been substantially foreshortened in length as compared to width, but that the track can be provided in any suitable relative length, width and/or shape;

FIG. 2 is a partial bottom view of the track section of FIG. 1;

FIG. 5 is a side sectional view at the juncture between two adjacent track sections.

Figure 3A:
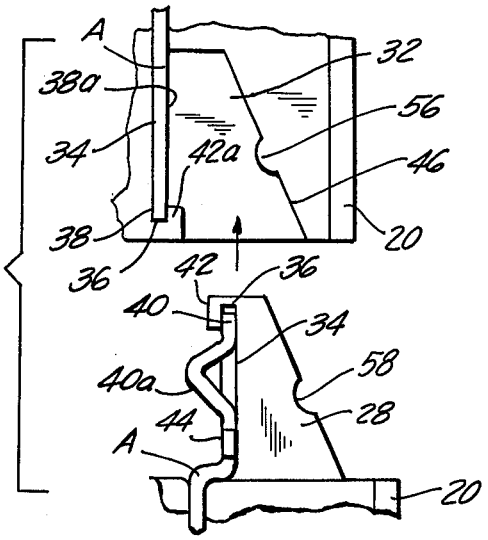
FIGS. 3A–3C are a sequence of views illustrating the connection of one track section to another.

Referring now to the drawings in detail, and initially to FIG. 1 thereof, a toy vehicle track section 10 is illustrated which is adapted to be used in a toy vehicle race game of the type disclosed in U.S. Patent Application Ser. No. 747,441 filed Dec. 6, 1976 and U.S. Patent Application Ser. No. 747,442 filed Dec. 6, 1976. The disclosure of those applications are incorporated herein by reference. The track section provides two adjacent lanes 12, 14 in which toy vehicles may move, bounded by side walls 20, 22. In the toy vehicle race games of the above mentioned patent applications, toy vehicles are provided for movement along the track and a remote control system is provided by which the vehicles can be steered to move from one lane to another, at the operator's command. This steering is accomplished by the control of the polarity of current supplied to the electric motors of the toy vehicles as they move along the track. This current is supplied through a plurality of contact strips imbedded in the track itself, and electrically connected to a current source. The current is picked up by collectors on the bottom of the toy vehicles for supply to the electric motor of the vehicle. Accordingly in such games it is imperative that the contact strips in each track section be in continuous electrical contact with the strips of adjacent track sections along the entire length of the track so that the electrical supply circuit is continuous and uninterrupted to insure that a constant supply of current is provided to the toy vehicles.

In the illustrative embodiment of the present invention each of the lanes 12, 14 is provided with three electrically conductive metal strips A, B, C respectively. As described in the above mentioned applications, strips A and B of both lanes are respectively connected to each other for providing control and supply of current to the two toy vehicles of the game while the conductive strip C is connected to electrical ground. These strips consist of thin metal strips received in longitudinally extending slots 16 formed in the top surface of the base 18 of the track. That base is formed of an electrically non-conductive material such as plastic.

Slots 16 are formed in surface 18 in the molding operation forming the track, and they extend downwardly below surface 18, as seen in the inverted view of FIG. 2, into support or reinforcing bosses 24 formed on the lower surface of the track. These bosses serve to hold the thin metal strips in a vertical position. In order to prevent vertical pull out movement of the strips from slots 16, the strips are cut and laterally bent, as illustrated at 26 in the drawings, so that if the strip is pulled vertically, the bent portions of the strip will abut against the bottom of track surface 18 and resist vertical pull out of the strips.

In accordance with the present invention base 18 of track section 10 includes a plurality of projections 28 which have a generally wedge shaped configuration terminating in blunt ends 30. In addition the base includes complementary recesses 32 formed therein for receiving the wedge shaped projections of an adjacent track section. As illustrated in FIG. 1, in the preferred embodiment of the invention three projections are provided on each side of the track along with three recesses. Each recess and projection pair is associated with one of the electrical contact strips imbedded in the track, but it is contemplated that more projections and recesses may be provided in the track, which are not associated with electrical strips, if desired. It is also contemplated that all of the projections may be formed on one side of the track with all of the recesses on the other side of the track.

Figure 3B:
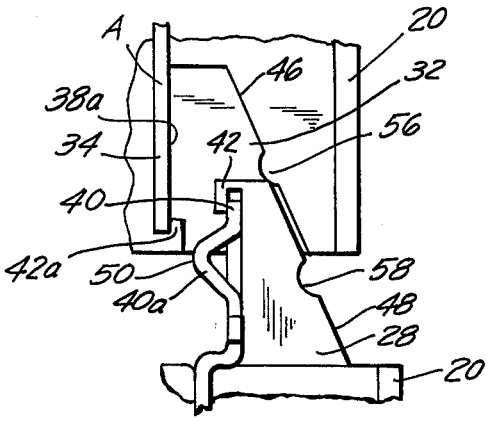
Figure 3C:
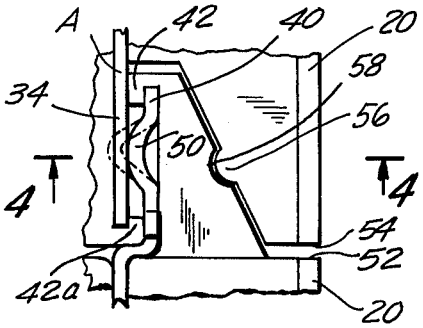

Projections 28 and recesses 32 have generally complementary longitudinally extending surfaces 34(FIG. 3*a*) along which the contact strip associated therewith extends. In addition, the recesses and projections include oppositely facing pockets or shoulders 36 which respectively receive the ends 38, 40 of their contact strip. These pockets define longitudinally offset steps or stepped portions 42 of the longitudinal surfaces 34 which are located such that in the assembled position the flange portions 42*a* of these stepped pockets, are located in longitudinal alignment with each other as illustrated in FIG. 3C.

The end 38 of the electrically conductive strips mounted in the recesses 32 are flat, so that one side 38*a* thereof is exposed to the recess 32. At the other end of the strip, the opposite side 40*a* of the strip is exposed (i.e. the side of the strip opposite side 34 of projection 28). This portion of the contact strip is bent, as seen in FIGS. 3A–3C to form a spring contact element. It also has a bend or recess 44 formed therein to receive the flange portion 42*a* of the shoulder portion 36 of the associated recess 32 in an adjacent track section.

To assemble the track sections of the present invention projections 28 are aligned with their complementary recesses 32 in an adjacent track section and the track sections are moved longitudinally with respect to each other so that projections 28 enter recesses 32. When this occurs the inclined surfaces 46, 48 of the projections and recesses slide along one another and urge the projections slightly laterally as they move into the recess to urge the bent portion 50 of the contact strip end 40 into engagement with the surface 38*a* of the associated contact strip in the adjacent track section. This longitudinal sliding movement permits the bend 50 of the contact strip to wipe the other contact strip to insure a good electrical connection therebetween.

When projections 28 are fully seated in their complementary recesses, i.e. when the ends 52, 54 of the adjacent track sections engage one another, the bent portion 50 of the contact strips in the projections are flexed against the contact strips in the recesses of the adjacent track section to insure a good electrical connection therebetween. Because of the stepped offset portions 36 of the projections and recesses, as well as the receipt of the flange portion 42*a* in the recess 44 of the spring, there is a resilient resistance to removal of the track elements from one another, which will firmly hold the track elements in place until disassembly is desired. In addition however it is contemplated that a detent arrangement can be provided on at least one of the projections and its associated recess in order to more firmly resist longitudinal disengagement of adjacent track sections. In the illustrative embodiment of the invention the guide wall 46 of one of the recesses 32 is provided with an enlargement or detent 56 in the form of a semi-cylindrical boss. This detent is adapted to be received in a complementary semi-cylindrical recess 58 in the wall 48 of an associated projection 28. Because of the resilient nature of the plastic material of which the projections and base 18 are formed, the projections 28 will be readily inserted in recesses 32 past detent 56, and when the detent and recess are engaged, a greater resistance to outward longitudinal movement will be produced. However this resistance is readily overcome by manually pulling the tracks apart. Its purpose is to prevent inadvertent longitudinal movement of the track sections when the game is in use.

Figure 4:
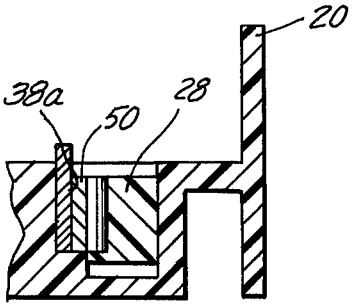
FIG. 4 is a sectional view taken along line 4—4 of FIG. 3C.

The bent ends 40*a* of the contact strips received in the projections 28 have a reduced height as compared to the height of the remainder of the strip (see FIGS. 1, 4 & 5). The major portion of the ends 40*a* is dimensioned in height to be substantially flush with the top surface 49 of their associated projection 28, and include transition sections 50 which slope from the short portion of end 40*a* to the full height of the contact strip near the track surface 18.

By shaping the end 40*a* of the contact strip in this manner and by forming projections 28 such that their top surfaces 49 are slightly below the level of surface 18 the end of the contact strip will not extend above the contact strip end 38 in its cooperating recess 32 should the track sections become misaligned. That is, as seen in FIG. 5, because of an irregularity in the surface on which the track sections are placed, or because of an angulation between the track sections along a ramp in the track or the like, the planes in which the top surfaces of the adjacent strip ends 38, 40*a* lie in a pair of connected track sections may be at an angle to each other. If the strip end 40*a* were of uniform height with the rest of the strip it would project above strip end 38 and might form an obstacle to movement of a toy vehicle along the track in the direction of arrow X in FIG. 5. This occurs because the end 40 of the projection 28 is further from the pivot point 52 at the lower edge of the track section than the extreme end of the strip end 38 in the recess 32. However by reducing the height of the strip end 40*a* and projection 28 in the manner previously described, a smooth transition between adjacent track section strips is provided.

In FIG. 5 the track sections are inclined upwardly at their connection so they, in effect, pivot about their lower edges at point 52; if however the track sections were pivoted downwardly at this point instead, the projection 28 would simply extend downwardly at its cooperating recess since the depth of the recess is greater than the height of the projection (see FIG. 4) so that, again, a smooth transition is provided.

Accordingly it is seen that a relatively simply constructed toy vehicle section is provided which is assembled by a simple longitudinal sliding movement of one track section with respect to the other. That sliding movement causes the contacts of the conductor strips to wipe one another and insure proper electrical connection therebetween. The configuration of the projections and contact strip ends permits a degree of locking of the track sections to one another, which locking is aided by the provision of the detent and recess arrangement 56, 58. Thus the desired rapid and easy interconnection, as well as the assured electrical connection between adjacent contact strips, is provided without any undesirable lateral or transverse sliding movement between the respective track sections and without any unnecessary twisting of the track sections with respect to each other. Moreover the contact ends are protected in their associated pockets to insure against any possible bending or damage as a result of the track assembly procedure. This is in contradistinction to previously proposed track section arrangements wherein the contact ends are left free and exposed where they are liable to be damaged during the assembly operation.

Although an illustrative embodiment of the present invention has been described herein with reference to the accompanying drawings, it is to be understood that the invention is not limited to that precise embodiment, and that various changes and modifications may be effected therein by one skilled in the art without departing from the scope or spirit of this invention.

What is claimed is:

1. A toy vehicle track section for use with similar track sections to form an interconnected track; said track section comprising a base formed of an electrically non-conductive material having opposite ends and a track surface along which a vehicle can move; one of said ends having a plurality of generally wedge shaped projections extending longitudinally therefrom; said projections having upper surfaces lying in planes below the plane of said track surface; the other of said ends having a plurality of generally wedge shaped recesses formed in said track surface, said recesses each having an open side at the track surface and an open end at said other of the track ends for receiving the projections of an adjacent track section in contacting engagement, upon longitudinal insertion of said projections through said recess ends, said recesses and projections having cooperating means formed thereon for resisting longitudinal disengagement of the projections from the recesses of an adjacent track section whereby connected track sections may pivot about a horizontal axis with respect to one another about their adjacent ends without producing an obstruction above said track surface.

2. A toy vehicle track section as defined in claim 1 wherein said recesses each have a base and a depth between said track surface and said base which is greater than the height of said projections; and said projections end have a bottom surface located above and spaced from the base of its associated recess.

3. A toy vehicle track section as defined in claim 2 including a plurality of said projections and recesses formed in each of said ends.

4. A toy vehicle track section as defined in claim 3 wherein said cooperating means comprises a detent and cooperating complementary relief recess formed in at least one of said recesses and a correspondingly located projection.

5. A track section as defined in claim 4 wherein said wedge shaped recesses and projections have generally complementary longitudinally extending vertical guide surfaces located generally perpendicularly of their associated ends and generally complementary inclined vertical guide surfaces angularly related to said perpendicularly extending guide surfaces, said perpendicularly extending guide surfaces being located to be in juxtaposition to each other when adjacent track sections are connected.

6. A track section as defined in claim 5 including a plurality of electrically conductive strips in said base respectively associated with one of said projections and recesses on opposite ends of the track section and extending therebetween; said strips having opposed ends respectively located adjacent the perpendicularly extending guide surfaces of their associated recess and projection, with one of said end portions being flat and the other of said end portions being bent to form a spring contact whereby when said projections are inserted in said recesses they cause their associated conductive strip end to engage a corresponding strip on an adjacent track section.

7. A track section as defined in claim 6 wherein said flat ends of the strips are positioned in said recesses and said bent ends are located in said projections.

8. A toy vehicle track section as defined in claim 6 wherein the end portions of the contact strips are formed to be substantially flush with the top of their associated projection and includes a tapered ramp section adjacent the juncture of the projection and its associated base end to provide an exposed transition section in the conductive strip between the track surface and the lower top surface of the projection thereby to insure the provision of a substantially continuous contact strip between the track section when the joined track sections are pivoted with respect to one another.

9. A track section as defined in claim 7 wherein each of said perpendicularly extending vertical guide surfaces has a free end and a flange formed on said free end having a pocket formed therein opening rearwardly towards the track and receiving therein the free end of the conductive strip end associated therewith to prevent longitudinal movement of the conductive strips in the base.

10. A track section as defined in claim 9 including cooperating means on said base and contact strips for preventing vertical movement of the conductive strips in the base.

11. A toy vehicle track section for use with similar track sections to form an interconnected track along which said vehicles may operate; said track section comprising a base formed of an electrically non-conductive material having opposite ends and a track surface along which a vehicle can move; a plurality of longitudinally extending projections formed on one end of said section, a plurality of complementary recesses formed on the opposite end of said track section for receiving the projections of an adjacent track section said recesses having an open side at the track surface and an open end at said other end of the track for receiving the projections of an adjacent track section; said recesses and projections each having generally complementary longitudinally extending vertical guide surfaces located perpendicularly of their associated ends and being sized so that the connected track sections may pivot about a horizontal axis with respect to one another about their adjacent ends without producing an obstruction above said track surface; and a plurality of conductive strips mounted in said track and respectively extending between a projection and recess on opposite ends of the track section, said strips having opposed ends respectively located adjacent the vertical guide surfaces of their associated projection and recess, with one of said strip ends being flat and the other of said strip ends being bent to form a spring contact, whereby when said projections are inserted in said recesses they cause their associated conductive strip end to engage a corresponding strip in an adjacent track section connected thereto; and at least one of said recesses and projections having cooperating means formed thereon for resisting longitudinal disengagement of the projections from the recess of an adjacent track section.

12. A toy vehicle track section as defined in claim 11 including a plurality of said projections and recesses formed in each of said ends.

13. A toy vehicle track section as defined in claim 11 wherein said cooperating means comprises a detent and cooperating complementary relief recess formed in at least one of said recesses and a correspondingly located projection.

14. A track section as defined in claim 11 wherein said flat ends of the strips are positioned in said recesses and said bent ends are located in said projections.

15. A track section as defined in claim 14 including cooperating means on said base and contact strips for preventing vertical movement of the conductive strips in the base.

16. A track section as defined in claim 11 wherein each of said perpendicularly extending vertical guide surfaces has a free end and a flange formed on said free end having a pocket formed therein opening rearwardly towards the track and receiving therein the free end of the conductive strip end associated therewith to prevent longitudinal movement of the conductive strips in the base.

17. A toy vehicle track section as defined in claim 11 wherein said projections have upper surfaces lying in planes below the plane of said track surface and the end portions of the contact strips are formed to be substantially flush with the top of their associated projection and include a tapered ramp juncture of the projection and its associated base end to provide an exposed transition section in the conductive strip between the track surface and the lower top surface of the projection thereby to insure the provision of a substantially continuous contact strip between the track section when the joined track sections are pivoted with respect to one another.

18. A toy vehicle track section as defined in claim 17 wherein said recesses each have a base and a depth between said track surface and said base which is greater than the height of said projections; and said projections end have a bottom surface located above and spaced from the base of its associated recess.

19. A toy vehicle track section for use with similar track sections to form an interconnected track along with a vehicle may operate; said track section comprising a base formed of an electrically non-conductive material having opposite ends and a track surface along which a vehicle can move; a plurality of longitudinally extending projections formed on one end of said section; said projections having upper surfaces lying in planes below the plane of said track surface; a plurality of complementary recesses formed on the opposite end of said track section for receiving the projections of an adjacent track section; said recesses having an open side at the track surface and an open end at said opposite end of the track for receiving the projections of an adjacent track section therethrough upon longitudinal insertion of said projections through said recess ends; said recesses and projections each having generally complementary longitudinally extending vertical guide surfaces located perpendicularly of their associated ends; a plurality of conductive strips mounted in said track and respectively extending between a projection and a recess on opposite ends of the track section, said strips having opposed ends respectively located adjacent the vertical guide surfaces of their associated projection and recess, with one of said strip ends being flat and the other of said strip ends being bent to form a spring contact, whereby when said projections are inserted in said recesses they cause their associated conductive strip end to engage a corresponding strip in an adjacent track section connected thereto; whereby connected track sections may pivot about a horizontal axis with respect to one another about their adjacent ends without producing an obstruction above said track surface.

20. A track section as defined in claim 19 wherein said flat ends of the strips are positioned in said recesses and said bent ends are located in said projections.

21. A toy vehicle track section as defined in claim 20 wherein said projections and recesses have oppositely facing pockets formed therein adjacent said vertical guide surfaces and said strips have extreme free end portions received in said pockets whereby longitudinal movement of the strips is prevented.

22. A toy vehicle track section as defined in claim 21 wherein said strips have opposed sides and said pockets are arranged to expose the opposite sides of said strips at its associated recess and projection respectively, whereby said bent portion of the strip defines a contact surface on one side of the strip at the projection for wiping and contacting the opposite side of a corresponding conductive strip in an adjacent track section to which it is connected.

23. A toy vehicle track section as defined in claim 22 wherein a plurality of said projections and recesses are formed on each end of the track section.

24. A toy vehicle track section as defined in claim 22 wherein said projections and recesses have a generally wedge shaped complementary configuration and said longitudinally extending vertical guide surfaces and adjacent pockets thereon formed complementary offset stepped surface portions; said contact strip ends adjacent said projections being bent to receive said step surface portions whereby said track section will longitudinally align with an adjacent track section when assembled and be releasably interlocked.

25. A toy vehicle track section as defined in claim 24 wherein said recesses each have a base and a depth between said track surface and said base which is greater than the height of said projections; and said projections end have a bottom surface located above and spaced from the base of its associated recess.

26. A toy vehicle track section as defined in claim 25 wherein the end portions of the contact strips are formed to be substantially flush with the top of their associated projection and includes a tapered ramp section adjacent the juncture of the projection and its associated base end to provide an exposed transition section in the conductive strip between the track surface and the lower top surface of the projection thereby to insure the provision of a substantially continuous contact strip between the track section when the joined track sections are pivoted with respect to one another.

27. A track section as defined in claim 19 including cooperating means on said base and contact strips for preventing vertical movement of the conductive strips in the base.

* * * * *